US008959796B2

(12) United States Patent
Lazaris

(10) Patent No.: US 8,959,796 B2
(45) Date of Patent: Feb. 24, 2015

(54) FOOTWEAR

(76) Inventor: Vasilios Lazaris, Ellicott City, MD (US)

( * ) Notice: Subject to any disclaimer, the term of this patent is extended or adjusted under 35 U.S.C. 154(b) by 409 days.

(21) Appl. No.: 13/467,942

(22) Filed: May 9, 2012

(65) Prior Publication Data

US 2012/0285039 A1 Nov. 15, 2012

Related U.S. Application Data

(63) Continuation-in-part of application No. 29/416,896, filed on Mar. 28, 2012, now Pat. No. Des. 693,995.

(60) Provisional application No. 61/484,906, filed on May 11, 2011.

(51) Int. Cl.
*A43B 3/12* (2006.01)
*A43B 7/26* (2006.01)
*A43B 3/10* (2006.01)

(52) U.S. Cl.
CPC .. *A43B 7/26* (2013.01); *A43B 3/102* (2013.01)
USPC ..... 36/11.5; 36/94; 36/97

(58) Field of Classification Search
CPC ..... A43B 7/26; A43B 3/26; A43B 3/12
USPC ..... 36/11.5, 94, 97
See application file for complete search history.

(56) References Cited

U.S. PATENT DOCUMENTS

| | | | | |
|---|---|---|---|---|
| 1,090,731 | A | | 10/1913 | Lindberg |
| 1,772,179 | A | | 6/1928 | Finkelstein |
| 2,424,056 | A | | 11/1945 | Ruth |
| 2,740,207 | A | | 4/1956 | Starensier |
| 2,954,617 | A | * | 10/1960 | Yamaguchi ..... 36/11.5 |
| 3,967,390 | A | * | 7/1976 | Anfruns ..... 36/94 |
| 4,017,987 | A | | 4/1977 | Perez, Jr. et al. |
| D278,608 | S | | 4/1985 | Thompson |
| 4,651,354 | A | | 3/1987 | Petrey |
| D321,971 | S | | 12/1991 | Bajork |
| 5,623,734 | A | * | 4/1997 | Pugliatti ..... 2/239 |
| 5,749,100 | A | * | 5/1998 | Rosenberg ..... 2/239 |
| 5,774,898 | A | | 7/1998 | Malpee |
| 5,867,838 | A | | 2/1999 | Corry |
| 5,906,007 | A | | 5/1999 | Roberts |
| 5,913,592 | A | * | 6/1999 | Moore ..... 36/8.1 |
| 6,334,222 | B1 | | 1/2002 | Sun |
| 7,051,457 | B1 | | 5/2006 | Huggins et al. |
| 7,107,626 | B1 | | 9/2006 | Andrews |
| D579,181 | S | | 10/2008 | Swanson |
| 7,437,838 | B2 | * | 10/2008 | Nau ..... 36/102 |

(Continued)

OTHER PUBLICATIONS

Sazzi Toe Motion Footwear; www.sazzi.com. No Admission That This Is Prior Art.

*Primary Examiner* — Marie Bays
(74) *Attorney, Agent, or Firm* — Michael E. Zall

(57) ABSTRACT

A shoe that includes a shoe sole having a medial side and a lateral side, a top insole surface for placement of the foot sole and toes thereon and a bottom outsole surface. The shoe sole has a plurality of toe extensions projecting below the toes. Each toe extension is configured to support and retain at least one toe. Preferably there are five toe extensions, one for each toe. A shoe upper overlays the arch region, is attached to the lateral side and the medial side of the shoe sole and extends toward the toes. The upper is joined to the insole of each toe extension to partially encircle the toe(s) supported and retained on such toe extension, and leaving at least the front region of all the toes exposed.

20 Claims, 15 Drawing Sheets

(56) References Cited

U.S. PATENT DOCUMENTS

| | | | | |
|---|---|---|---|---|
| D581,654 | S | 12/2008 | Miliotis | |
| D582,134 | S | 12/2008 | Von Conta et al. | |
| D586,982 | S | 2/2009 | Fliri | |
| 7,739,810 | B2 * | 6/2010 | Luedecke et al. | 36/114 |
| 7,784,115 | B1 | 8/2010 | Nemcik | |
| 7,805,860 | B2 * | 10/2010 | Fliri | 36/94 |
| D630,005 | S | 1/2011 | Fliri | |
| D639,535 | S * | 6/2011 | Eggert et al. | D2/898 |
| D640,043 | S | 6/2011 | Buck | |
| 8,572,868 | B2 * | 11/2013 | Fliri | 36/94 |
| 2002/0157169 | A1 | 10/2002 | Holloway | |
| 2008/0127520 | A1 * | 6/2008 | Luedecke et al. | 36/102 |
| 2008/0189984 | A1 | 8/2008 | Januszewski et al. | |
| 2010/0299962 | A1 | 12/2010 | Fliri | |
| 2012/0000094 | A1 | 1/2012 | Fliri | |
| 2012/0144699 | A1 * | 6/2012 | Eggert et al. | 36/99 |
| 2013/0118031 | A1 * | 5/2013 | Chenciner | 36/88 |

* cited by examiner

FOOTWEAR

RELATED APPLICATIONS

This application claims priority to U.S. Provisional Application No. 61/484,906 filed on May 11, 2011, the entire disclosure of which is incorporated herein by reference. This application is also a Continuation-in-Part (CIP) of U.S. Ser. No. 29/416,896 filed on Mar. 28, 2012, the entire disclosure of which is incorporated herein by reference.

FIELD OF THE INVENTION

The present invention relates to footwear, and more particularly shoes, sandals, running shoes and other type shoes, having a toe portion that affords each toe individual support and movement, and exposure to the air to minimize infection.

BACKGROUND OF THE INVENTION

There are many different styles of shoes. However, current shoe designs and styles generally cramp the toes and do not permit the individual toes to move in a biomechanically natural manner. When the conventional shoe is worn, the entire front toe cap portion acts as a single unit. The movement of the toe cap portion is generally limited to a pivoting action about the ball of the foot. Additionally, the toe cramp causes pain and chafing of the toes which can become damp and a breeding ground for infection. Feet require solid support, correct positioning and exposure to the atmosphere and sun for maximum comfort and health and optimum movement of the toes.

It is generally accepted, that biomechanical toe movement is critical to the efficient overall movement of the body. Toe motion and the overall tactile response of the foot to various surfaces play a vital role in walking, jogging, running, etc., and in supporting and maintaining a person's balance and agility.

Early attempts have been made to provide footwear having individual portions which encapsulate each toe separately, see for example the following U.S. Patents:

U.S. Pat. No. 3,967,390 to Anfruns
U.S. Pat. No. 4,651,354 to Petrey
U.S. Pat. No. 5,774,898 to Malpee More recent attempts to focus on this aspect of footwear were made by Vibram S.p.a. (Five Fingers®) and Fila USA (Skele-toes®), see for example the following U.S. Patents and Publications:

U.S. Pat. No. 7,805,860 to Fliri
U.S. 2010/0299962 to Fliri
U.S. 2012/0000094 to Fliri
D579,181 to Swanson
D582,134 to Von Conta et al.
D586,982 to Fliri
D630,005 to Fliri
D639,535 to Eggert et al.

Applicant is aware of the following additional U.S. Patents and Publications:

U.S. Pat. No. 1,090,731 to Lindbero
U.S. Pat. No. 1,772,179 to Finkelstein
U.S. Pat. No. 2,424,056 to Ruth
U.S. Pat. No. 2,740,207 to Starensier
U.S. Pat. No. 4,017,987 to Perez, Jr. et al.
U.S. Pat. No. 5,623,734 to Pugliatti
U.S. Pat. No. 5,867,838 to Corry
U.S. Pat. No. 5,906,007 to Roberts
U.S. Pat. No. 6,334,222 to Sun U.S. Pat. No. 7,051,457 to Huggins et al.
U.S. Pat. No. 7,107,626 to Andrews
U.S. Pat. No. 7,739,810 to Luedecke et al.
U.S. Pat. No. 7,784,115 to Nemcik
US 2002/0157169 to Holloway
US 2008/0189984 to Januszewski et al.
D278,608 to Thompson
D321,971 to Bajork
D581,654 to Miliotis
D640,043 to Buck.

Some of these patents disclose shoes or athletic footwear wherein each toe is independently enclosed or encapsulated in the shoe. The object of such a structured shoe is to provide independent articulation for each of the toes. However, while walking or running with such shoes the toes are restricted from sliding forward and/or extending, thus inhibiting proper blood circulation and causing the toes to cramp, chafe and causing general discomfort. This discomfort and pain is compounded during running due to the increased stress and movement of the foot within the shoe in that they cannot properly accommodate for the forward thrust of the forefoot and toes. Additionally, shoes that completely encapsulate the toes prevent exposure of the toes to the atmosphere, restricting aeration and ventilation which assists in preventing infections of the foot.

Footwear that provides complete exposure of the toes is well known in the art, i.e., your typical thong sandal or slide. However, such shoes do not provide for the individual securement, support, articulation and protection for each toe.

Thus, there is a need for footwear wherein the toes are exposed to permit aeration of the toes and to also provide for the individual securement, support, articulation and protection for each toe.

SUMMARY OF THE INVENTION

It is an object of this invention to provide footwear wherein the toes are exposed to permit aeration of the toes and there is individual securement, support, articulation and protection for each toe.

It is a further object of this invention to provide footwear in the form of a shoe made of a resilient and flexible material that permits each toe of the foot to maintain independent movement and articulation.

It is a yet another object of this invention to provide a shoe that assists in providing proper weight distribution for the user when walking and helps support the foot's natural shape and structure.

Another object of this invention is to provide a shoe that improves posture and balance for greater comfort when walking.

Yet another object of this invention is to provide a shoe of that permits each toe of the foot to have independent movement that stimulates circulation in the foot, permits the toes to be exposed to the air and sun which assists in preventing infection in the toe areas all while uniquely conforming to the shape and size of each toe.

All of the above objects are achieved by the shoe of this invention. For clarity of explanation, the foot has a foot sole, an ankle region, a heel region, an arch region and toes, each toe including a front region.

The shoe comprises a shoe sole having a medial side and a lateral side, a top insole surface for placement of the foot sole and toes thereon and a bottom outsole surface. The shoe sole has a plurality of toe extensions projecting below the toes. Each toe extension is configured to support and retain at least one toe. Preferably there are five toe extensions, one for each toe. A shoe upper overlays the arch region, is attached to the lateral side and the medial side of the shoe sole and extends toward the toes. The upper is joined to the insole surface of each toe extension to partially encircle the toe(s) supported and retained on such toe extension, and leaving at least the front region of all the toes exposed.

Additional aspects, objectives, features and advantages of the present invention will become apparent from the following description of the preferred embodiments with reference to the attached drawings.

BRIEF DESCRIPTION OF THE DRAWINGS

For a more complete understanding of the present invention, reference may be had to the following description of exemplary embodiments of the present invention considered in connection with the accompanying drawings, of which.

DETAILED DESCRIPTION OF THE INVENTION

Figure 1:
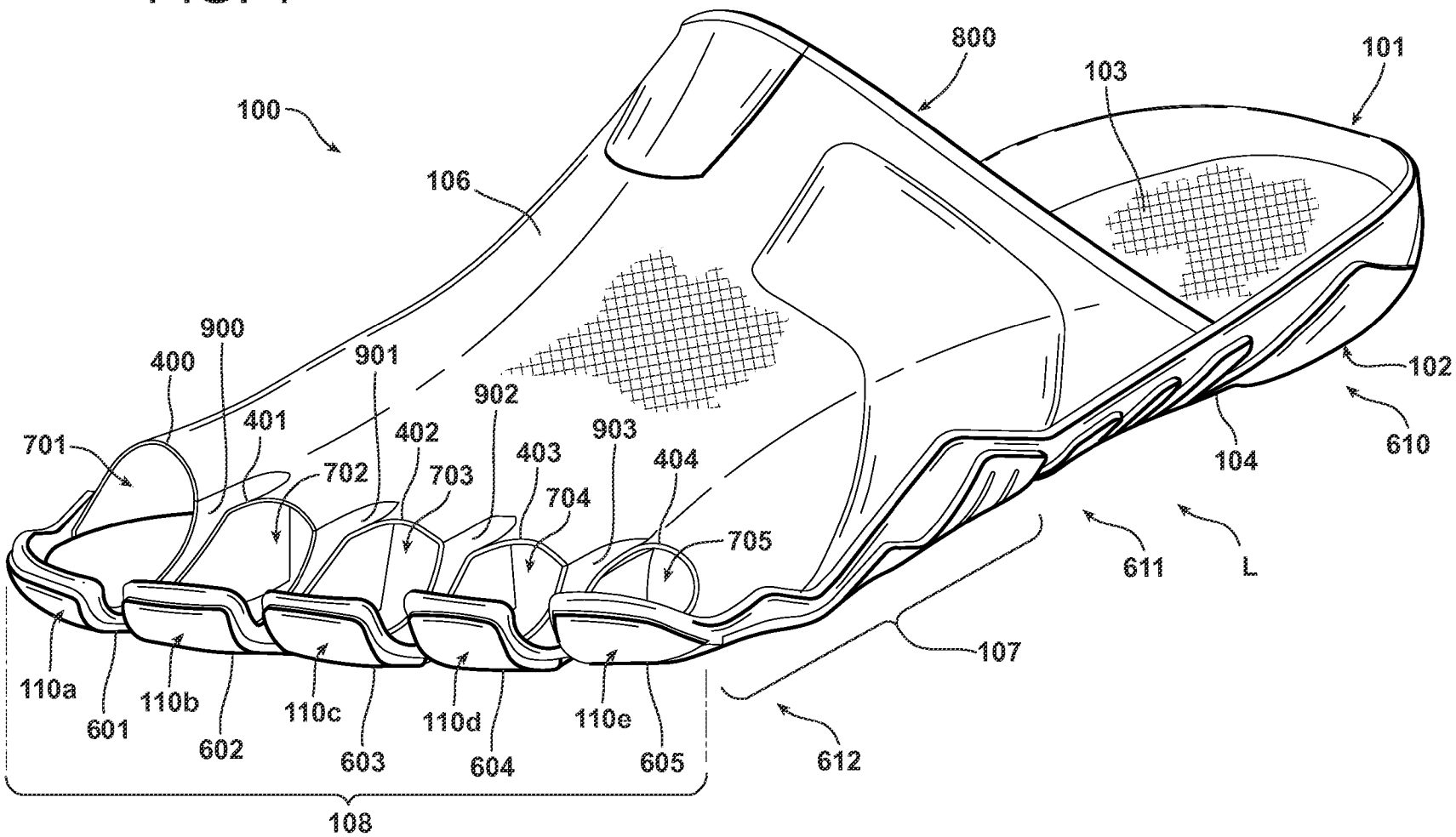
FIG. 1 is a front, lateral side, perspective view of a first embodiment of this invention in the form of a sandal shoe.

FIG. 1 is a perspective view of the shoe 100. The shoe 100 may, for example, be a sandal, slipper, athletic shoe or running shoe, boot or other type shoe. In a preferred embodiment as depicted in the Figures herein, the shoe is a sandal or slipper.

Figure 14:
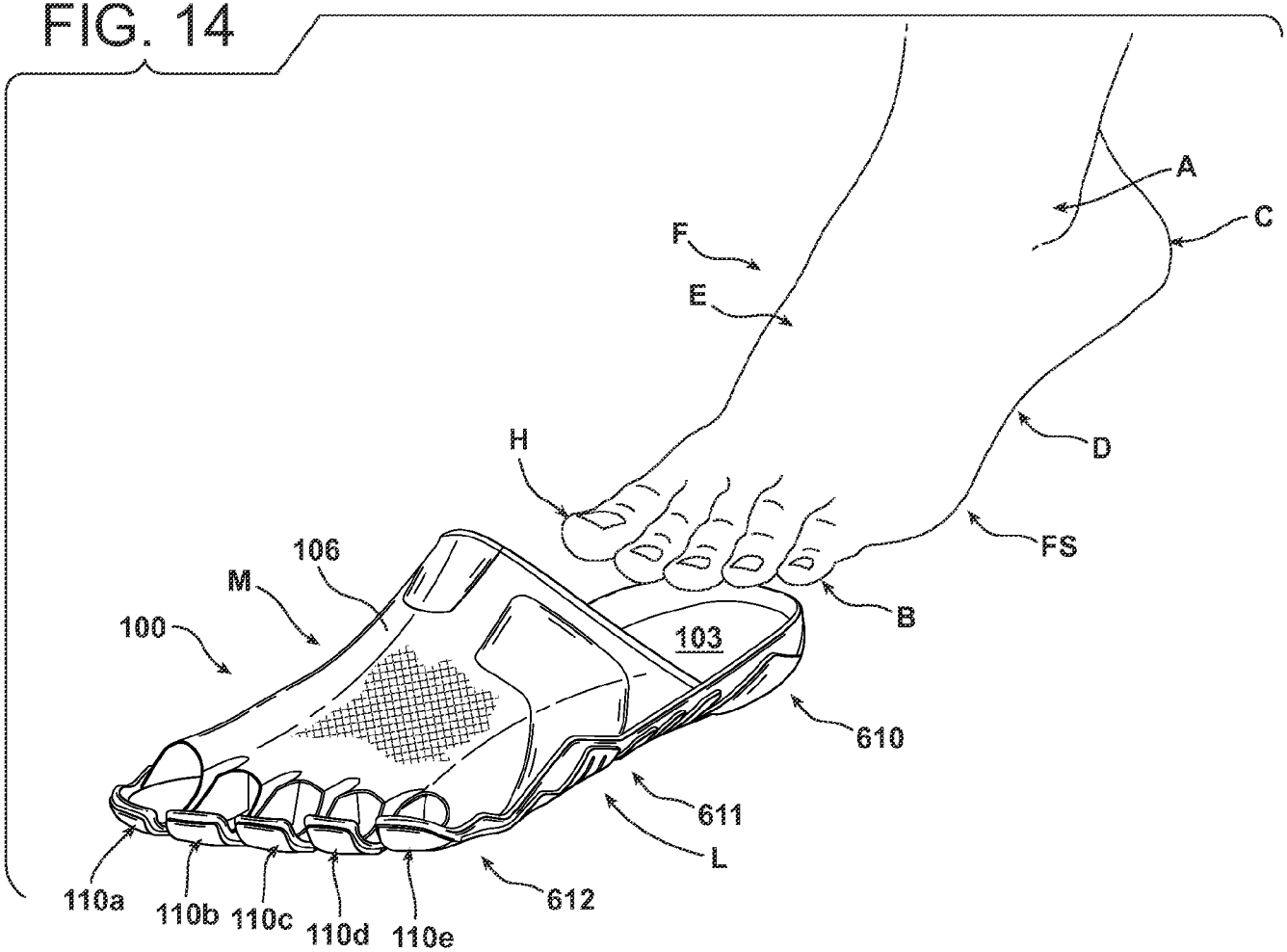
FIG. 14 is a front, lateral side, perspective view of the first embodiment of the shoe of this invention with the foot being inserted in the shoe showing the parts of the foot referenced herein.

Referring to FIG. 14, the shoe 100 is adapted to receive a foot F having a foot sole FS (foot bottom), an ankle region A, toes B, a heel region C, an arch region D and an instep region E. The foot F, as well as the shoe 100, has a medial side M and a lateral side L.

Figure 6:
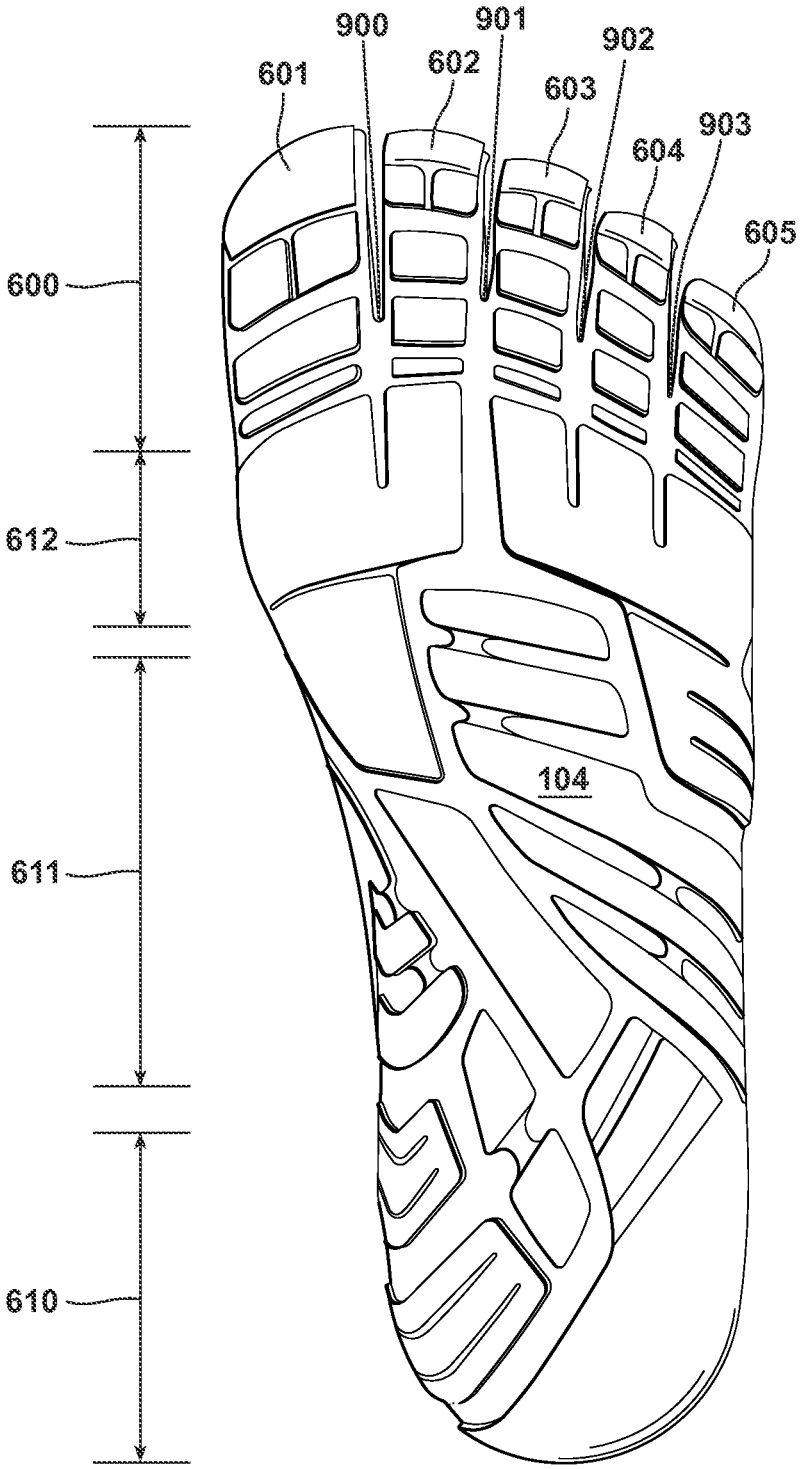
FIG. 6 is a bottom plan view, i.e., the outer sole 104, of the first embodiment of the shoe.

Referring to FIGS. 6 and 14, the footwear 100 includes several regions which generally correspond to various parts of the foot F. A rear foot portion 101 & 610 is disposed toward a rear of the footwear 100 and is generally configured for fitting around and supporting the heel C of a wearer. A mid-foot portion 611 extends forward from the rear portion 610 and corresponds generally with the arch D and instep area E of the foot F. A fore-foot portion 612 extends forward of the mid-foot portion 611 and generally corresponds to the area of the ball of the foot, that is, the area proximate to the joining of the metatarsals and proximal phalanges. A front portion 600 is the forward most region of the footwear 100 and generally aligns with, supports, and protects the toes B of the foot F.

Referring for example to FIGS. 1-6, the shoe 100 has a medial side M and a lateral side L, a footbed 102 having a top insole surface 103 for placement of the foot sole FS and toes B thereon and a bottom outsole surface 104 which contacts the ground. The outsole 104 is preferably formed of a flexible rubber material; however, the outsole can alternatively be comprised of ethylene vinyl acetate (EVA), polymeric type material, or any other material known to the art and various combinations thereof Preferably the top insole surface 103 of footbed 102 is made of a textile, material for comfort, e.g., slipper, but can be made of a wear and/or water resistant material, such as rubber, EVA, etc., that is still comfortable to the foot sole FS and conforms thereto. The contouring of the footbed 102 and outsole 104 can replicate and support the contour of the foot F. The footbed 102 and outsole 104 may be formed with varying thicknesses in designated areas to enhance contouring to the foot and to provide the wearer with the natural feeling of walking, running, etc.

Figure 2:
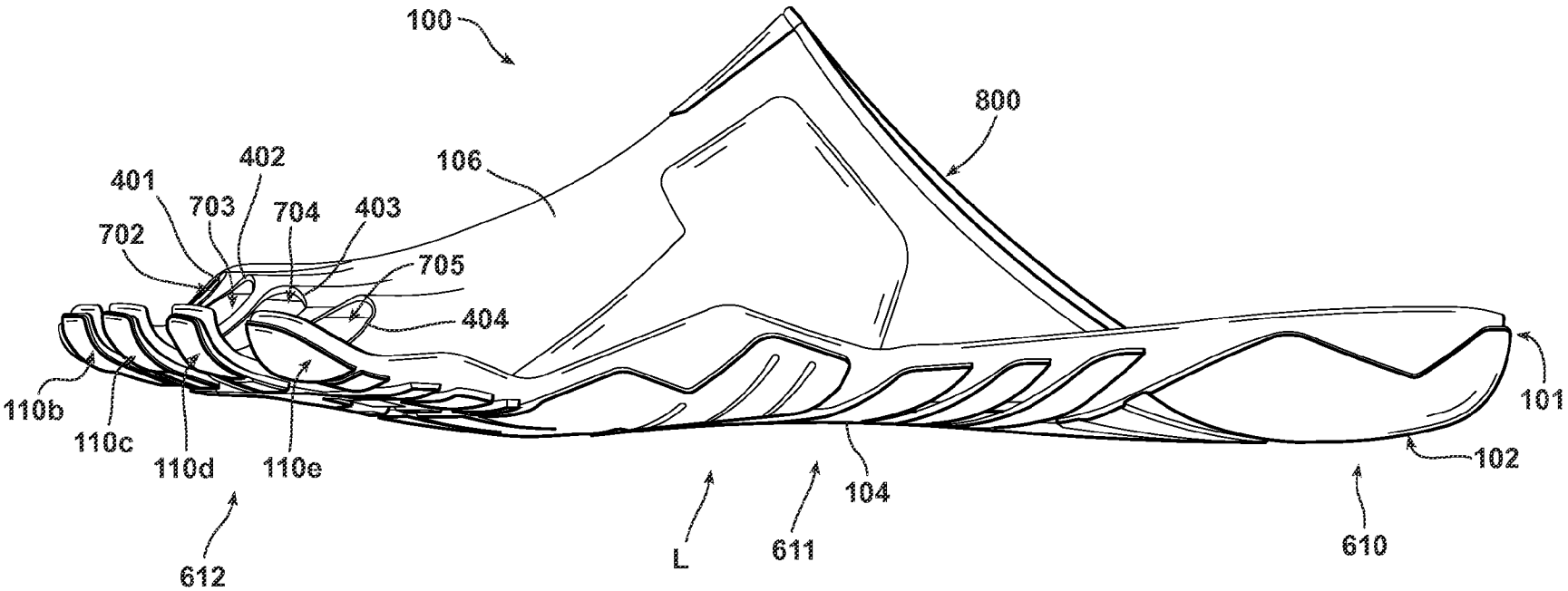
FIG. 2 is a left side elevation, lateral side, of the first embodiment of the sandal shoe depicted in FIG. 1.
Figure 3:
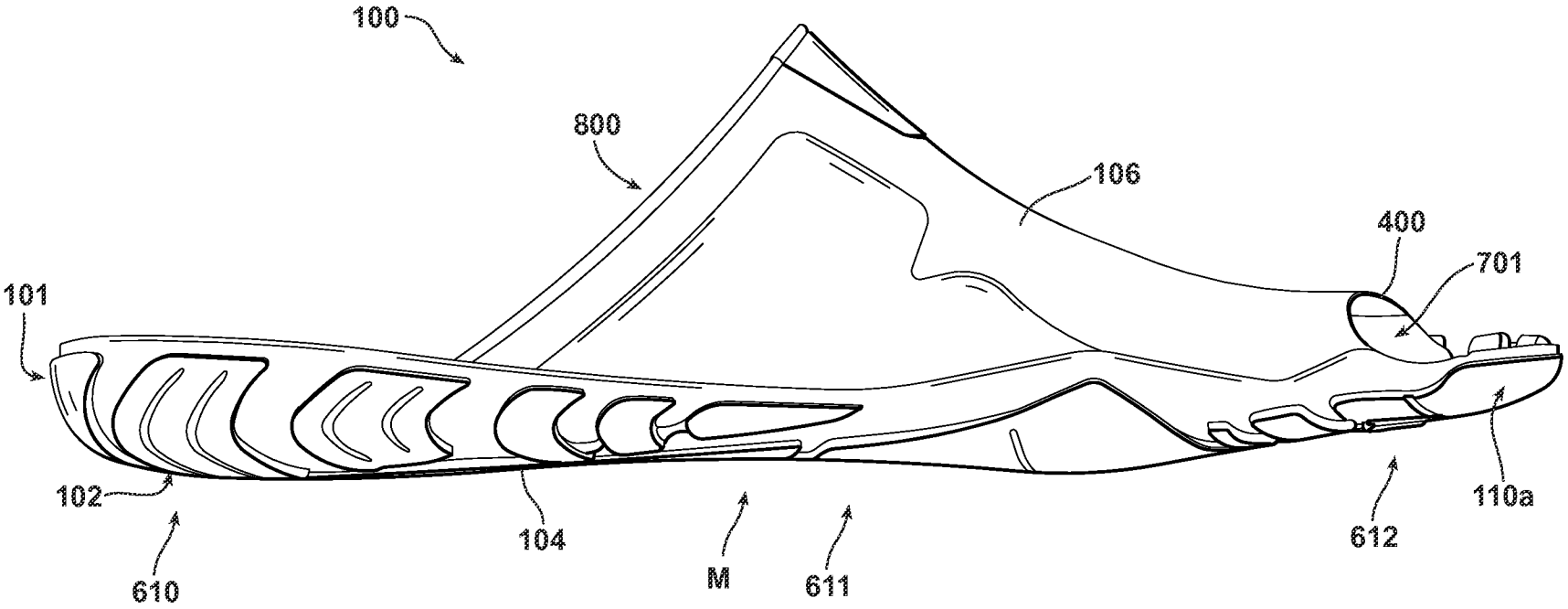
FIG. 3 is a right side elevation (medial side), of the first embodiment of the sandal shoe depicted in FIG. 1.

As depicted in FIGS. 1-3, the outsole 104 and footbed 102 can extend upwards along the medial M and lateral sides L of the shoe 100 so that it encloses, covers and/or nests a portion of the sides of the foot F. Optionally, as depicted in FIGS. 1 and 14 the outsole 104 and footbed 102 can extend upwards along the rear foot portion 101 of the shoe 100 so that it encloses, cover and/or nests a portion of the heel C of the foot F.

As depicted in FIGS. 1-3, 5, 8, 9, 14, and 17, in the preferred embodiment the rear foot portion 101 of the shoe 100 is open heeled such that the wearer's heel region C is exposed when the foot F is inserted in and supported by the shoe 100. The open heel region C affords the wearer the ability to slide the foot F in and out of the shoe 100, see FIG. 14 and is most suitable for sandals or slippers.

Referring for example to FIGS. 1, 2, 4 and 14, the shoe sole or footbed 102 has a plurality of individual toe extensions 110(*a-e*) projecting below the toes B, each toe extension 110(*a-e*) is configured to support and retain at least one toe B. In the preferred embodiments depicted herein, the shoe sole or footbed 102 has five individual toe extensions 110(*a-e*) projecting below each toe, at least along the length of the metatarsals, but preferably along both the metatarsals and phalanges. However, it is contemplated that a toe extension 110(*a-e*) may be configured to support and retain more than one toe (not shown).

Optionally, the top insole surface 103 of the footbed 102 can feature additional cushions or ridges to massage or support the toes and/or bottom of the foot F, particularly under the toes on the toe extensions 110(*a-e*).

Referring for example to FIGS. 1-4, the shoe 100 of this invention is further provided with a shoe upper 106. The upper 106 is designed to overlay the arch region D of the foot F when placed in the shoe 100. The upper 106 can be made of many materials, e.g., synthetic fabric, textiles, neoprene, rubber, polymers, leather, or any other materials known to the art. The upper 106 is attached to the lateral side L and the medial side M of the shoe sole or footbed 102 overlaying the arch region D and extends toward the toes B. The upper 106 may be secured to the footbed 102 by suitable means well known in the art, such as bonding or stitching.

Referring for example to FIGS. 1-5 and 14, the upper 106 of the shoe 100 is sized to receive and cover the top front surface of the wearer's foot, i.e., the arch D of the foot. The upper 106 is attached to the footbed 102 such that an opening 800 is formed between the footbed 102 and upper 106 of the shoe 100. The opening is sized to receive the wearer's foot. Shoe 100 having an open heel is shown. However, additional variations of the shoe 100 may be provided straps and/or a closed-heel shoe.

Figure 10:
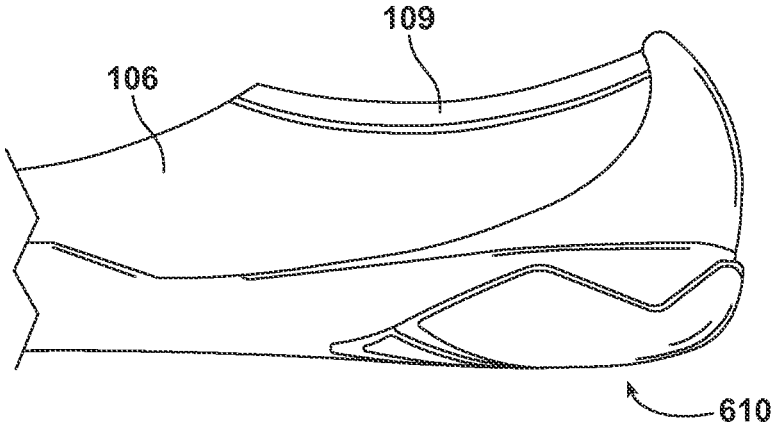
FIG. 10 is a left side elevation, i.e., lateral side, of an embodiment of a heel enclosure portion that may be used on the shoe of this invention.
Figure 12:
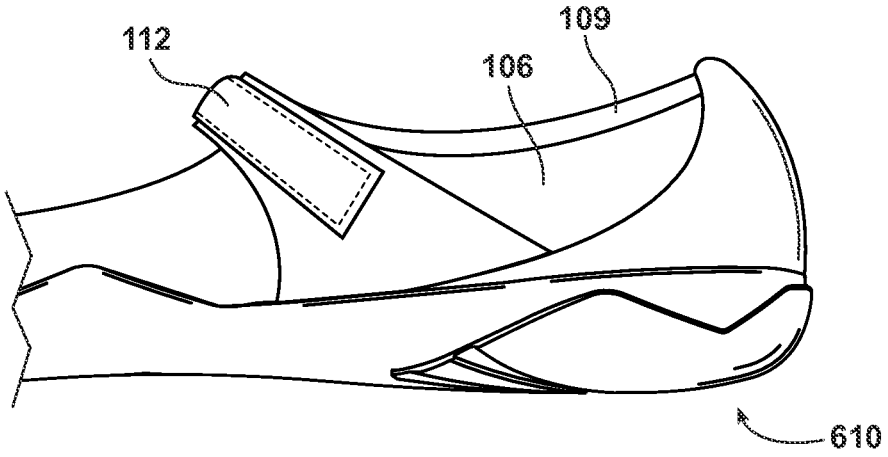
FIG. 12 is a left side elevation, i.e., lateral side, of yet another embodiment of the heel enclosure portion that may be used on the shoe of this invention.
Figure 13:
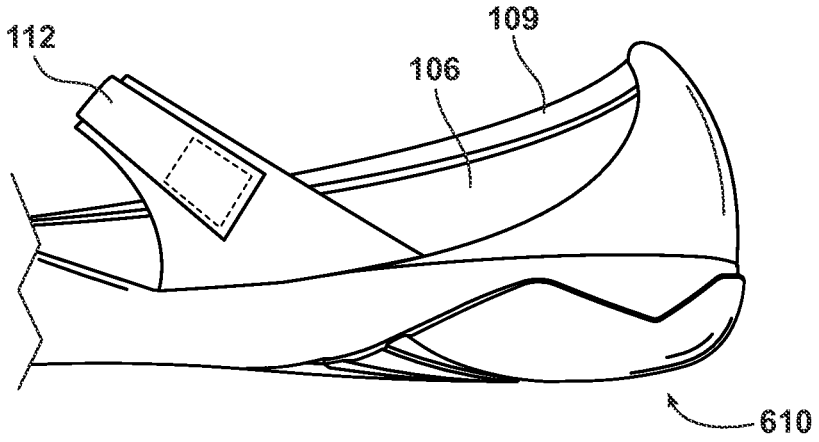
FIG. 13 is a left side elevation, i.e., lateral side, of still another embodiment of the heel enclosure portion that may be used on the shoe of this invention.

For example, in alternate embodiments of the shoe 100 of this invention, as depicted in FIGS. 10, 12 and 13, the upper 106 extends to the heel region C on the medial M and lateral L sides of the shoe sole or footbed 102, 104 to cup the heel region C of the foot F providing a closed-heel region which secures the heel region C in the shoe 100.

Figure 11:
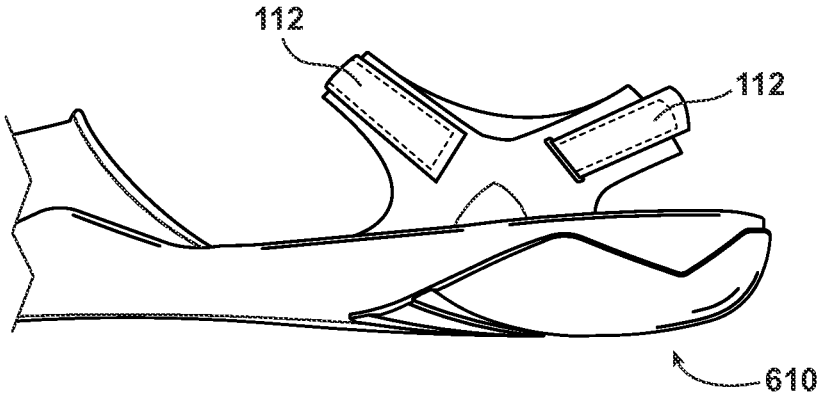
FIG. 11 is a left side elevation, i.e., lateral side, of another embodiment of the heel enclosure portion that may be used on the shoe of this invention.

In other alternate embodiments of the shoe 100 of this invention, as depicted in FIGS. 11, 12 and 13, a plurality of sandal straps 112 are attached to the lateral L and medial M sides of the shoe sole to removably encircle and secure the ankle region A when the foot F is placed on the insole or footbed 102. Referring to FIGS. 12 and 13, such an alternative may be used in combination with the previously described alternative wherein additionally the upper 106 extends to the heel region C on the medial M and lateral L sides of the shoe 100 to cup the heel region C to provide a closed heel region. In yet another alternate embodiment of the shoe 100 of the invention, as depicted in FIGS. 1, 10, 12, and 13, the upper 106 includes a collar 109 extending around an opening 800 through which the wearer inserts the foot into the shoe. The collar 109 may include an element (not shown) which draws the upper 106 toward the foot F of the upper to keep the footwear 100 securely on the foot.

Still referring to FIGS. 1-4, the upper 106 is joined to the top insole surface 103 of each toe extension 110(*a-e*) to partially encircle the at least one toe B supported and retained on such toe extension 110(*a-e*) and leaving at least the front region of all the toes B exposed. The front region of the toes exposed preferably corresponds to the phalanges of the toes and may also include the metatarsalia of the toes.

As previously indicated, in the preferred embodiments depicted herein, the shoe sole or footbed 102 has five separate toe extensions 110(*a-e*) projecting below each individual toe B and the upper 106 is joined to the insole, preferably the top insole surface 103 of each separate toe extension 110(*a-e*) to at least partially encircle the toe B resting on such toe extension 110(*a-e*) and leaving at least the front region of all the toes exposed. However, it is contemplated that a toe extension 110 may be configured to support and retain more than one toe and that the top insole surface 103 and the upper 106 is joined to the top insole surface 103 of each toe extension 110 to at least partially encircle more than one toe B that is supported and retained on such toe extension 110 and leave at least the front region of all the toes B exposed (not shown).

More specifically, referring to FIGS. 1-6, which depicts a preferred embodiment, the upper 106 overlying the arch region D of the foot F is attached to the forefoot area 107 of the footbed 102. The forefoot area 107 is the portion of the footbed 102 that supports the forefoot of the foot F. The upper 106 features a toe portion 108 having five individual supportive toe extensions 110*a*, 110*b*, 110*c*, 110*d*, 110*e* that each support a toe or digit of the foot. Each extension 110*a-e* supports an individual toe B of the foot F.

Referring to FIGS. 1-6, each extension 110(*a-e*) has a bottom surface, 601, 602, 603, 604 and 605, see FIG. 6. The upper 106 of the shoe 100 forms the tops 501, 502, 503, 504 and 505 to the toe extensions 110(*a-e*) which at least partially encircle each toe B resting on a toe extension 110(*a-e*), see FIG. 5. An opening 701, 702, 703, 704 and 705, is formed by the upper 106 and the extension 110(*a-e*) so that the toes can extend through the openings (701-705) onto the toe extensions 110(*a-e*) to allow for a natural fit and increased comfort and to expose them to the atmosphere so that oxygen can reach the toes to assist in preventing infections.

Figure 4:
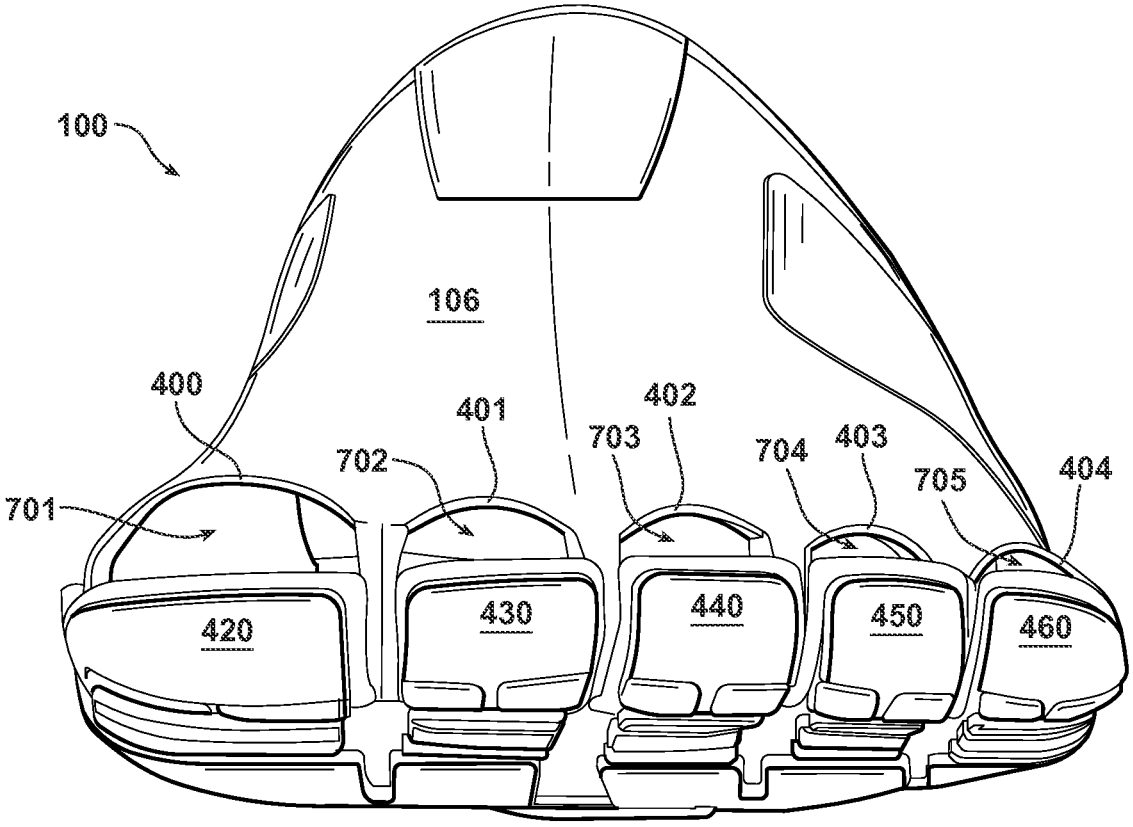
FIG. 4 is front plan view, i.e., toe portions, of the first embodiment of the shoe.
Figure 5:
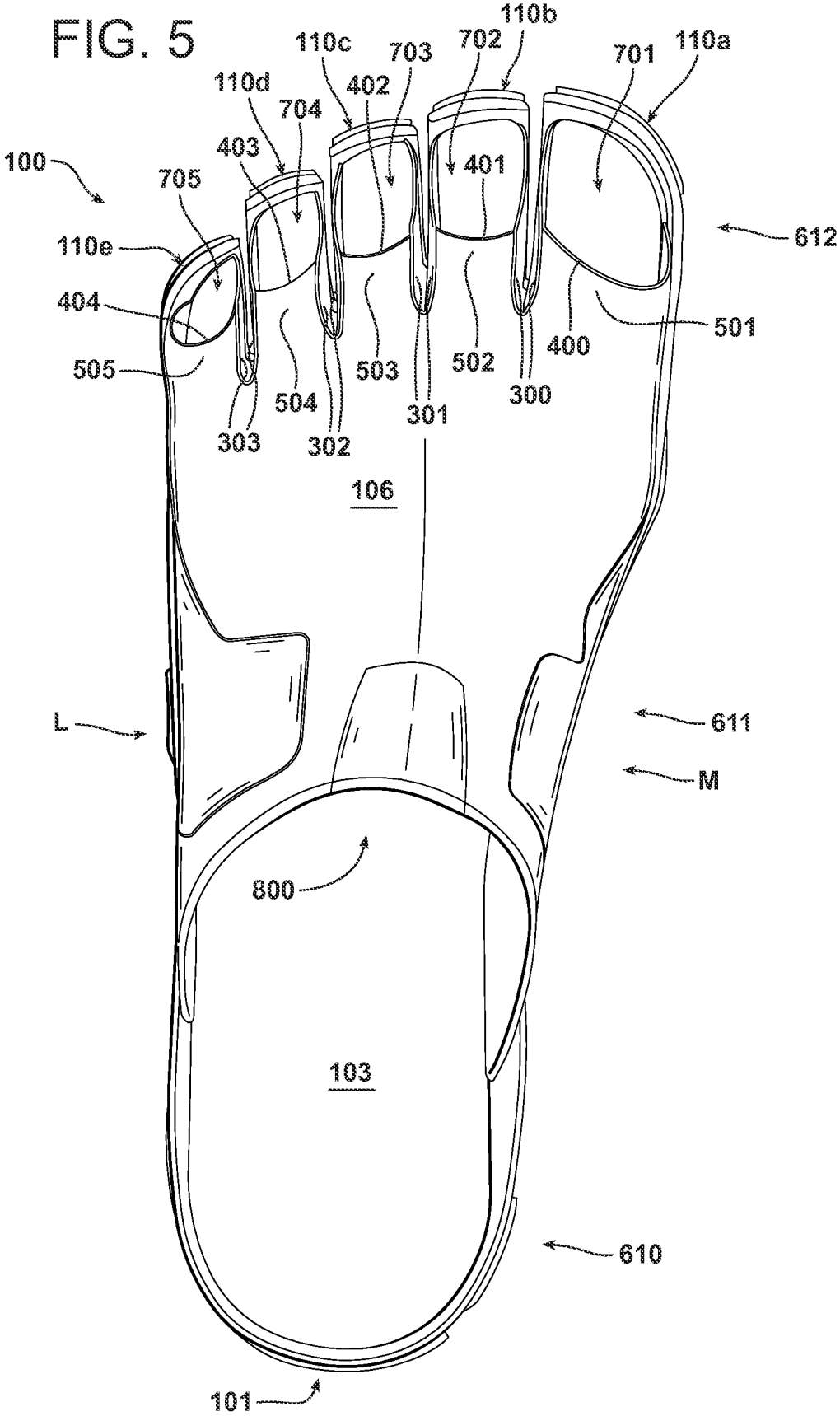
FIG. 5 is a top plan view of the first embodiment of the shoe.
Figure 7:
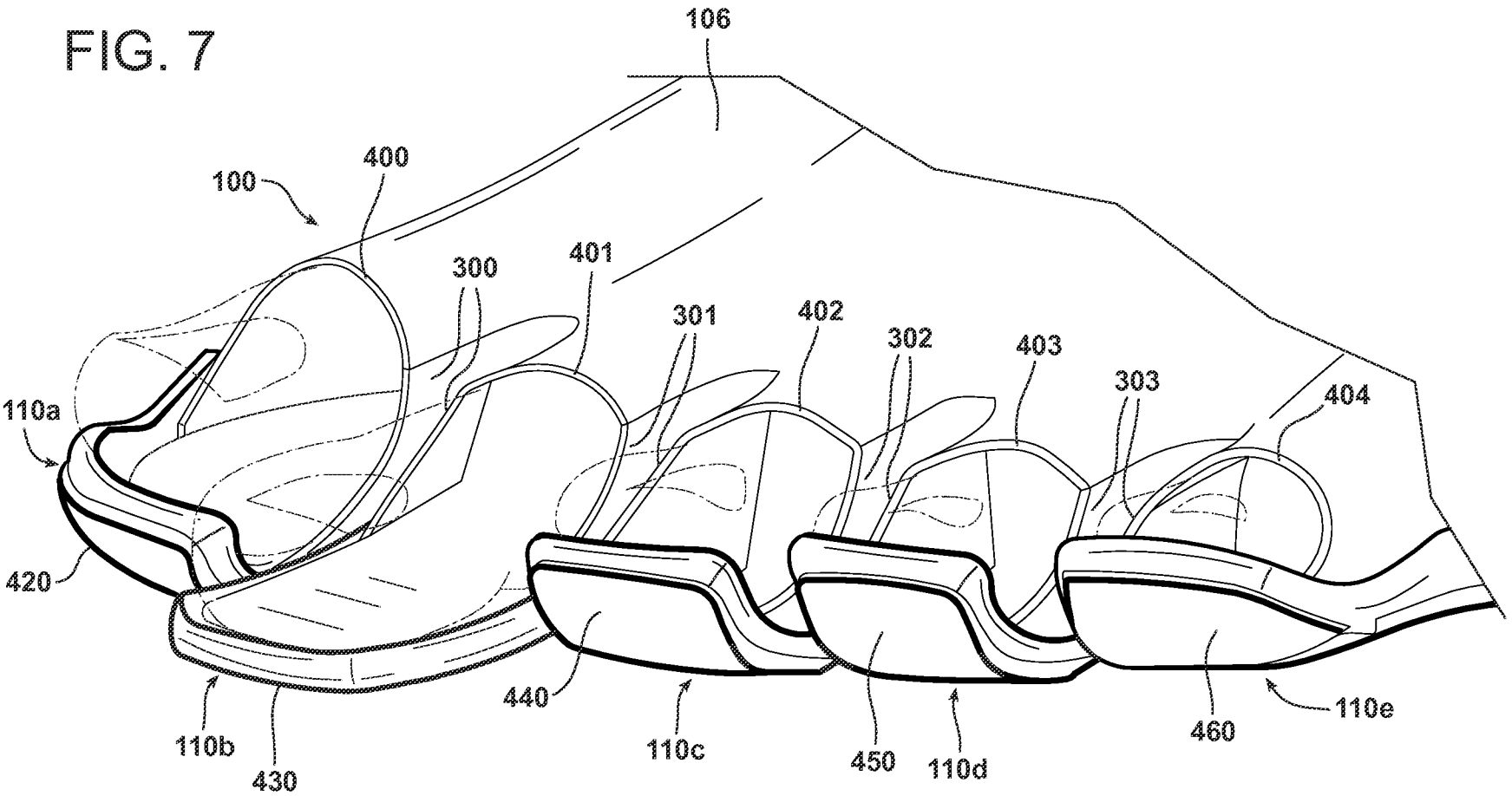
FIG. 7 is a front perspective view of a second embodiment the shoe of this invention, i.e., wherein the toe extension is flattened.

Referring for example to FIGS. 1, 4, 5, and 6, the upper 106 of the shoe 100 extends toward the toe portion 108 to form four joints or spaces 900, 901, 902, and 903 between the toe extensions 110(*a-e*). Referring to FIGS. 5, 6, and 7, each joint 900-903 has sidewalls 300, 301, 302, and 303 which extend beyond the inverted U edges 400, 401, 402, 403, and 404 towards the front region of toe extensions 110(*a-e*). The joints 900, 901, 902 and 903 and respective sidewalls 300-303 act as toe separators when the foot is placed in the shoe 100. Additionally, the sidewalls prevent each individual toe B from disengaging laterally from the corresponding toe extensions 110(*a-e*). The joints 900, 901, 902, and 903 and sidewalls 300-303 separate each toe extension 110(*a-e*) such that each toe B has its respective toe support extension 110(*a-e*). This provides each toe B the ability to move independently. For example, when the big toe or hallux toe H is positioned in toe support 110*a*, the toe and toe support 110*a* move together regardless of the movement of toes in toe supports 110*b*-110*e*. Optionally, one or more joints (900-903) with sidewalls (300-303) of upper 106 can feature varying materials or additional cushions to enhance comfort. These joints (900-903) and sidewalls (300-303) may be extensions of the material from which the upper 106 is constructed or individual pieces of the same or differing materials appropriately joined to the upper 106 material. Additional materials may be added to the upper 106 to add a unique or personalized design to the shoe 100.

Figure 8:
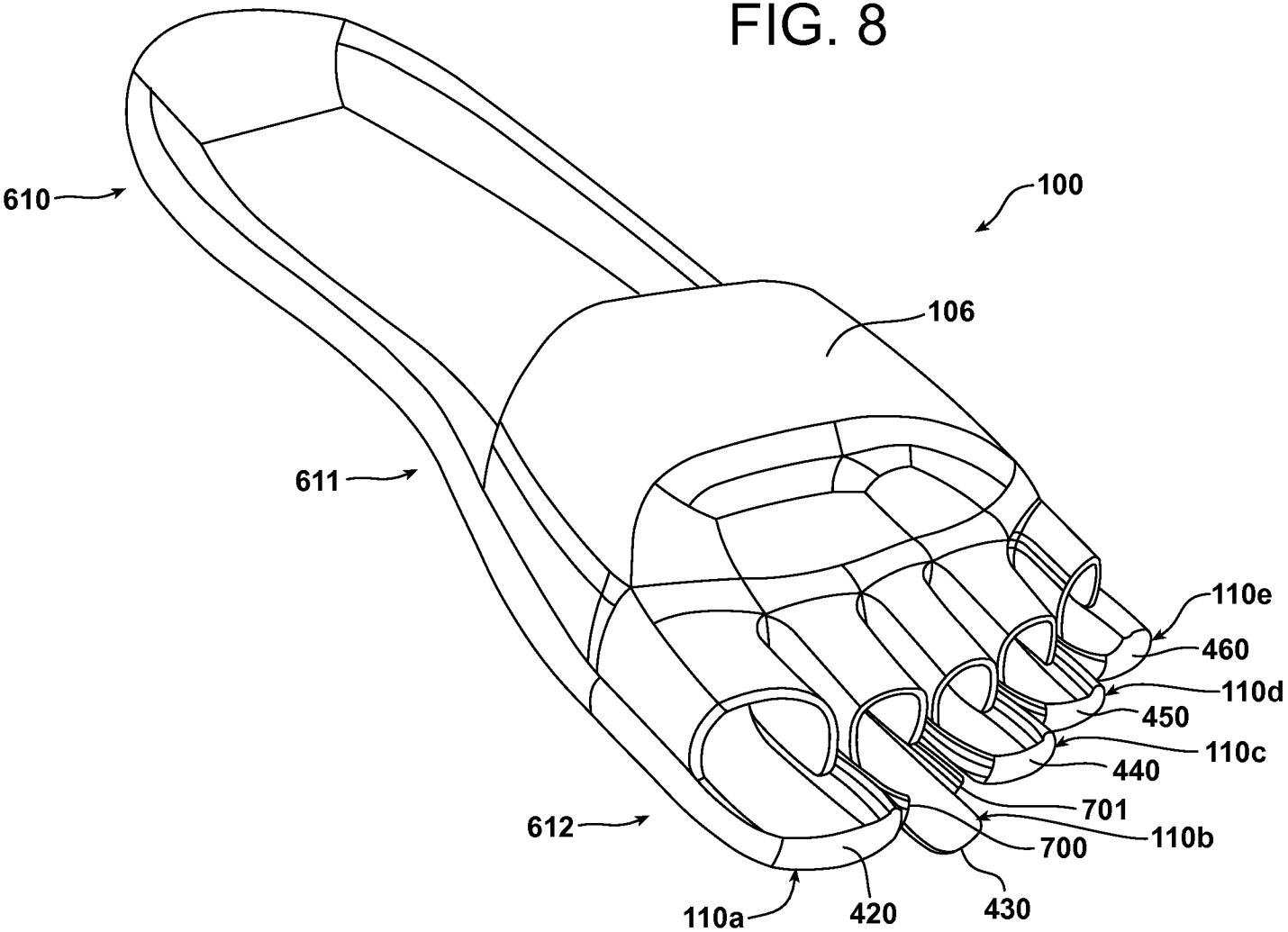
FIG. 8 is a top perspective view of a third embodiment of the shoe of this invention, i.e., wherein the toe extension is flattened.
Figure 9:
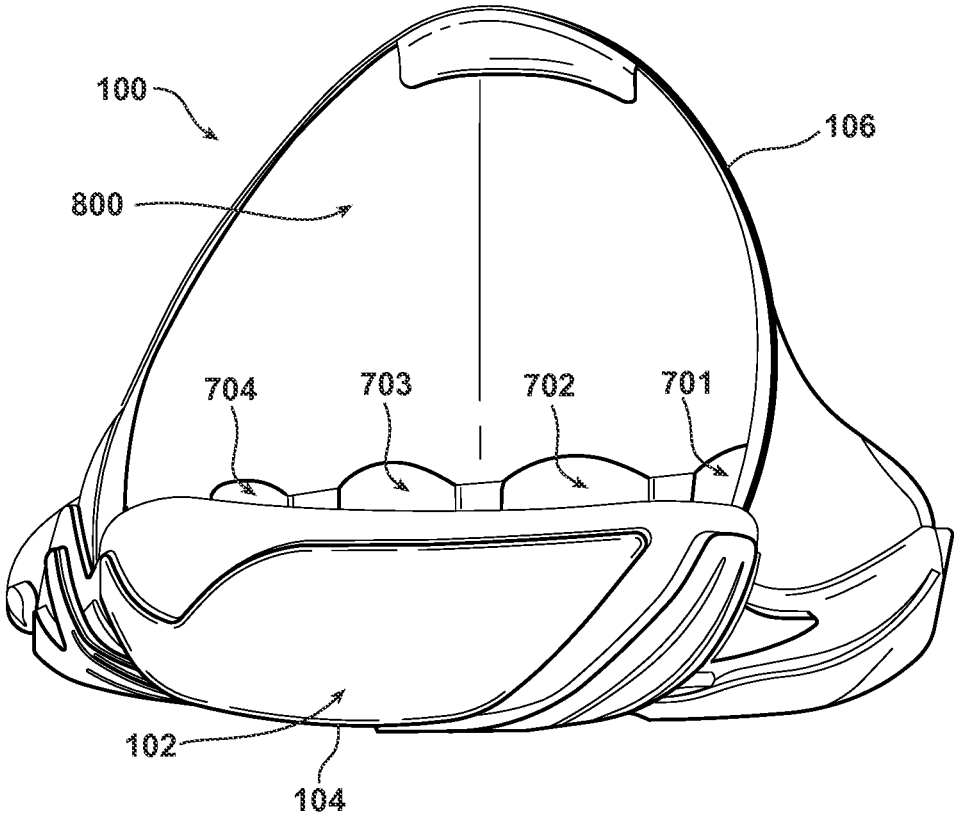
FIG. 9 is a rear plan view (taken from the heel position) of the first embodiment of the shoe of this invention.

Referring to FIG. 4, the inverted U edges 400, 401, 402, 403, and 404 are each an inverted U-configuration formed by the upper 106 secured to the footbed 102 at the top insole surface 103 of the footbed 102. The footbed 102 extensions 110(*a-e*) curve upward at their edges and the toe ends to form toe guards 420, 430, 440, 450, and 460. The toe guards 420, 430, 440, 450 and 460 extend upwardly from the bottom of the shoe 100 to form a protective guard around the front and the sides of each toe. This aids in preventing a stubbing of the toe and in preventing dust and debris from entering the shoe 100, particularly around the toes. Referring to FIG. 8, in an alternate embodiment, the footbed 102 extensions 110(*a-e*) curve upward to form sidewalls around a periphery of each toe extension 110(*a-e*). For example, toe extension 110*b* has sidewalls 700-701. In this way, the toe extensions 110(*a-e*) nest a portion of toes B to protect the toes at least partially from side impacts. Moreover, the toe guards 420-460 will provide additional support by extending/flattening when the weight or forward force of a toe is applied.

The shoe 100 preferably comprises a two piece structure, i.e., a footbed 102 and upper 106. However, additional structures may be added to the shoe 100 to prevent blistering and add extra comfort. For example, referring to FIG. 17 the shoe 100 may include an insole 105 and a midsole 111 for enhanced comfort and contouring to the foot. The insole 105 size and shape will be substantially similar if not identical to the size and shape of the footbed 102 and outsole 104. Alternatively, the upper 106 may be secured to the insole 105 by suitable means well known in the art, such as bonding, stitching, etc. The insole 105 along with the secured upper 106 may be secured to the footbed 102 by for example, bonding or stitching. However, the shoe 100 could be made as a one piece structure using a resilient material such as ethylene vinyl acetate (EVA), blown rubber or any other material known to the art.

Referring to FIG. 5, for example, the upper 106 ends at edges 400, 401, 402, 403 and 404 just above the extensions 110(*a-e*) wherein the toes are initially exposed. It is preferred that the shoe 100 toe supports 110(*a-e*) expose the top area of the wearer's foot comprising at the least a portion of the wearer's toe nails. Most preferably, the front region of the toes exposed corresponds to the phalanges of the toes and may also include the metatarsalia of the toes.

FIG. 6 is a bottom plan view of the shoe 100. The footbed 102 features a front portion 600 that supports the bottom of the wearer's toes. The footbed 102 has heel region 610 that supports the wearer's heel, a middle portion 611 that supports the middle portion of a wearer's foot and a front portion 612 that supports the front portion of the wearer's foot. The front toe portion 600 features the bottom surfaces 601, 602, 603, 604 and 605 of the toe support extensions 110(*a-e*), respectively. The bottom surfaces 601-605 features the outline of the wearer's toes and is designed to be sized to fit the wearer's foot in a manner to provide comfort and support. Traction or anti-slip grooves and cleat means can be added to the outsole 104 of the shoe 100.

Figure 15:
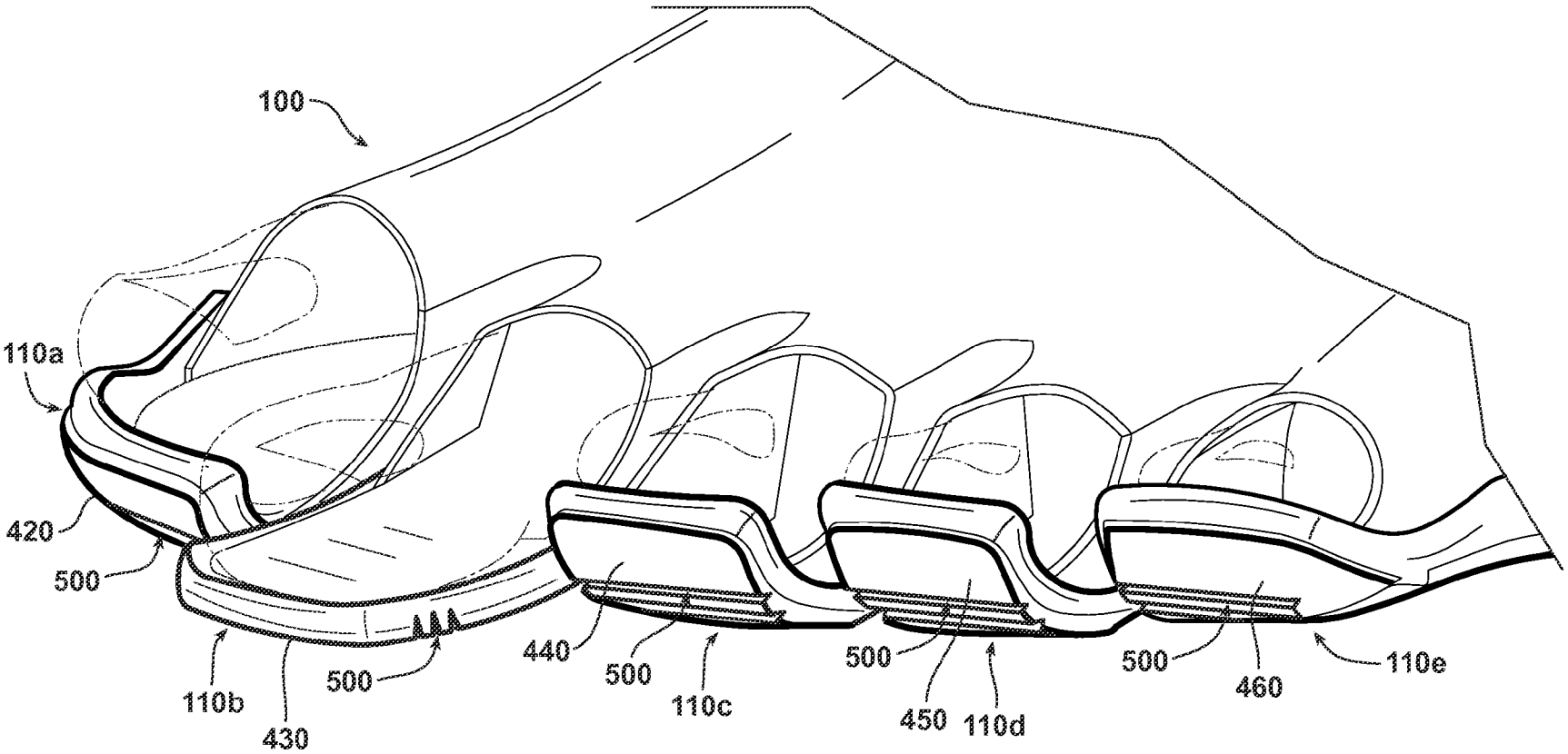
FIG. 15 is a front perspective view showing the toe portion of another embodiment of the shoe of this invention.
Figure 16:
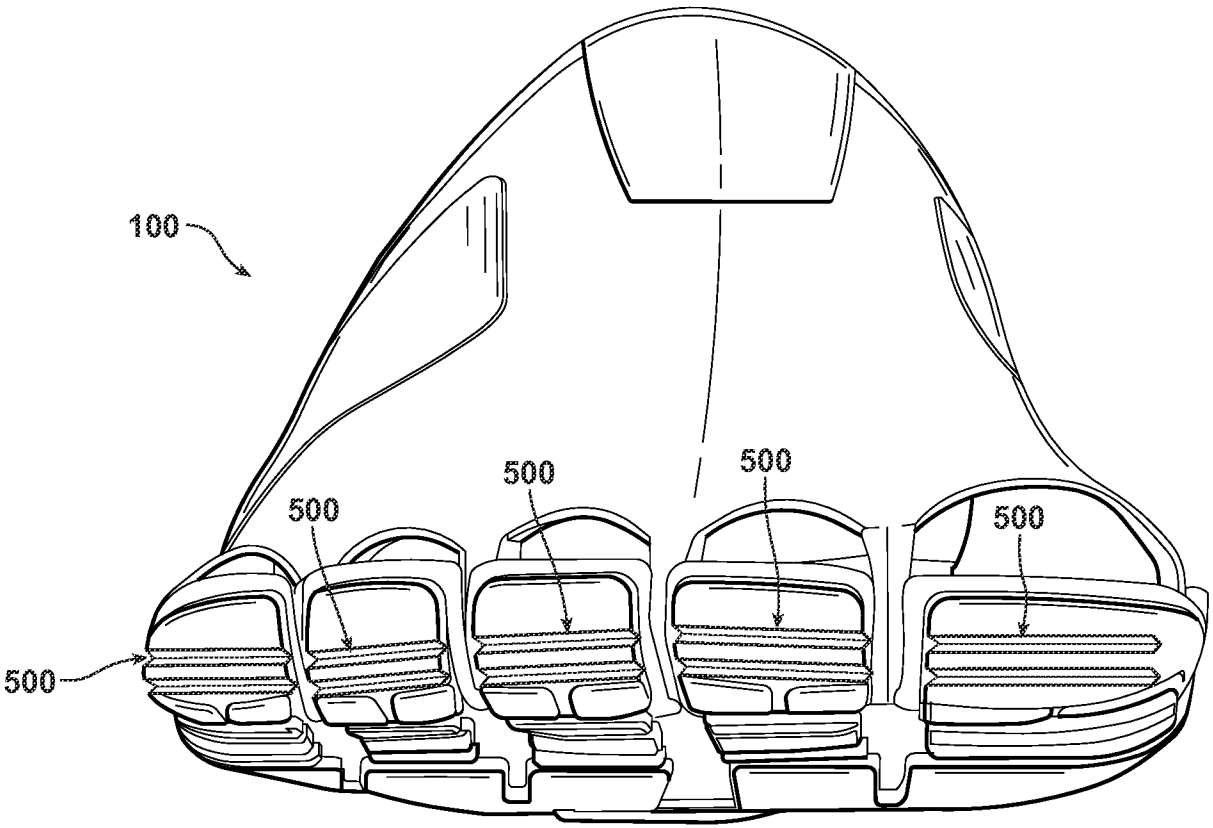
FIG. 16 is a front view showing the toe portion of the embodiment of the shoe of this invention depicted in FIG. 15.
Figure 17:
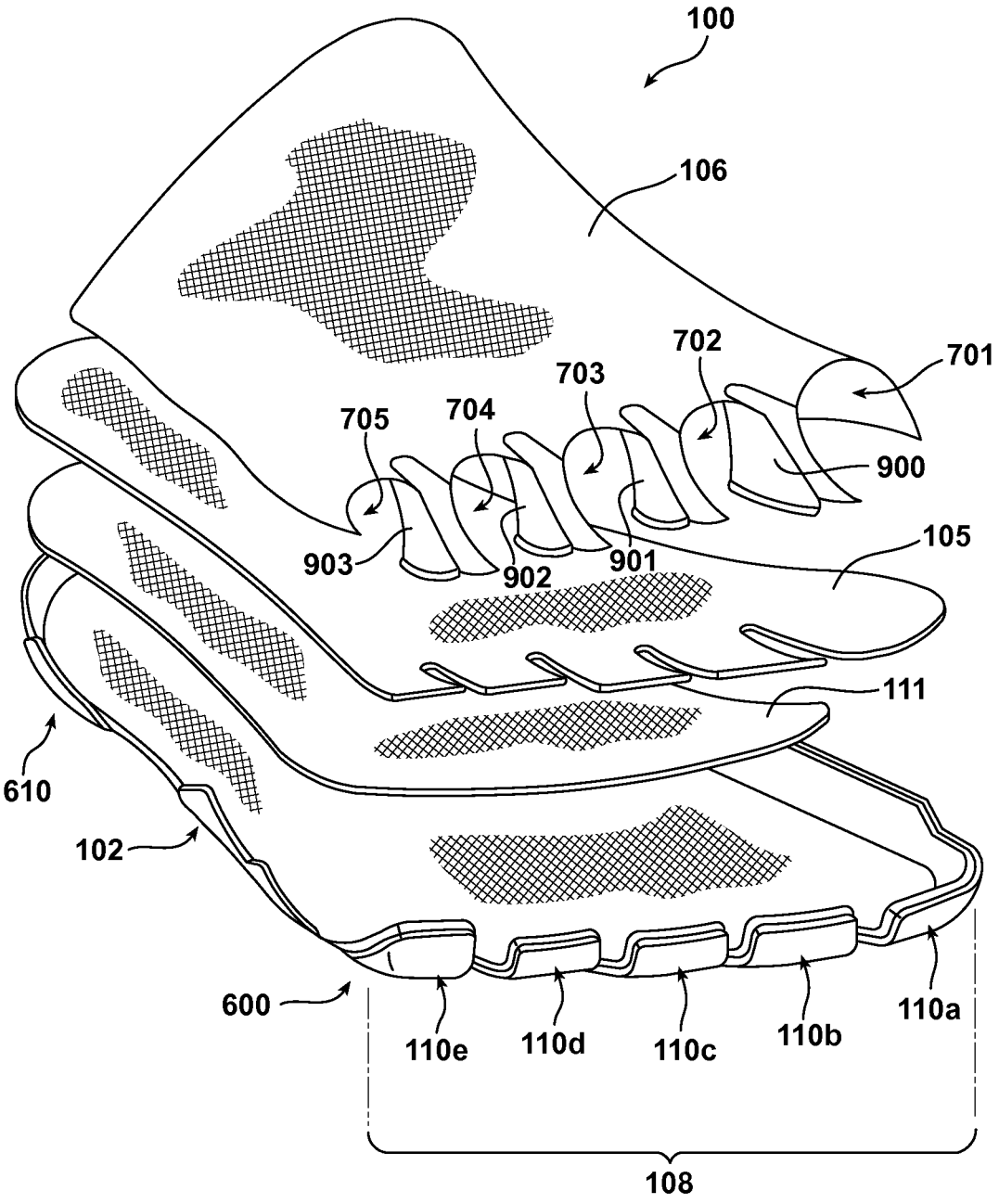
FIG. 17 is a schematic, exploded perspective view from the lateral side of an embodiment of the shoe described and claimed herein showing the assembly of the elements of the shoe.

FIGS. 7, 8 and 15, are views of the shoe 100 showing the toe guards 420-460. One or more of the toe guards 420-460 at the ends of the extension 110(*a-e*) extend upwardly from the bottom of the shoe 100. The toe guards 420-460 of the toe extensions 110(*a-e*) are flexible such that they can stretch out or extend and/or flatten to accommodate the forward force or weight of a toe. In use, the toe guards and toe extensions extend and/or flatten to support, protect, and adjust to the weight or forward force of each toe B as the foot and toes shift within the shoe while for example, walking or running. Alternatively, for example, in FIGS. 7 and 15, extension 110*b* and toe guard 430 extend and/or flatten to accommodate a large toe having Mortons syndrome. In FIGS. 15 and 16 the toe guards 420-460 have accordion-like end grooves 500 therein to permit the toe extensions to have added flexibility and elasticity to extend and/or flatten, i.e., self adjusting. Alternatively, the toe guards 420-460 and extensions 110(*a-e*), which may be made of a polymeric material, may be shaped or extended by the use of a heating device to soften the structures and allowing them to be stretched and/or flattened to a predetermined shape.

Optionally, the front of the toe guards 420-460 can be made of a material that will aid in gripping or walking on a surface to provide additional support and stability, Referring to FIG. 8, one or more toe guards 420-430 of toe extensions 110(*a-e*) can disengage from the respective sidewalls to extend/flatten when the weight or forward for of a toe is applied. For example, toe guard 430 of toe extension 110*b* is detached from sidewalls 700 and 701 to extend/flatten, by the weight or forward force of a toe in motion. Alternatively, if the wearer's toes are irregular, for example, the weight of the longer or larger toe applied to such toe extensions 110(*a-e*) will extend/flatten the toe guard 420-460 for such toe. When no force or pressure is applied to the toe guard, it will remain in an upward position as shown in FIG. 1

Alternatively (not shown), the shoe 100 can have webbing that connects the adjacent toe extensions 110(*a-e*) and, as previously indicated, may have one or more extensions 110 (*a-e*) configured to contain two or more toes.

Thus, this invention provides which protects the wearer from ground and surface hazards, allows increased touch, sensitivity, and full foot and toe articulation, provides free air circulation around the toes to prevent infection, and increases comfort and fit.

The invention has been described in detail with particular reference to certain preferred embodiments thereof, but it will be understood that variations and modifications can be effected within the spirit and scope of the invention.

The invention claimed is:

1. A shoe for placement of a foot therein, the foot having a foot sole, an ankle region, a heel region, an arch region and toes, each toe including a front region, the shoe comprising:

a shoe sole having a medial side and a lateral side, a top insole surface for placement of the foot sole and toes thereon and a bottom outsole surface, the shoe sole having a plurality of toe extensions projecting below the toes, each toe extension configured to support and retain at least one toe; and a shoe upper overlaying the arch region, attached to the lateral side and the medial side of the shoe sole and extending toward the toes, wherein the upper is joined to the insole of each toe extension to partially encircle the at least one toe supported and retained on such toe extension, and leaving at least the front region of all the toes exposed, wherein each toe extension has edges that curve upward around the toe to protect regions of the toe.

2. The shoe of claim 1, wherein the front region of the toes exposed corresponds to phalanges of the toes.

3. The shoe of claim 1, wherein at least one toe extension has a means for self-adjusting to the toe length.

4. The shoe of claim 1, wherein at least one toe extension has a plurality of grooves therein to form an accordion-like end to enable the extension to self-adjust to the toe length and have added flexibility and elasticity.

5. The shoe of claim 1, wherein each toe extension is made of a polymeric material that can be softened by heating and molded to a predetermined shape to accommodate the toe.

6. The shoe of claim 1, wherein each toe extension is connected to an adjacent toe extension by webbing.

7. The shoe of claim 1, wherein a plurality of sandal straps are attached to the lateral and medial sides of the shoe sole to removably encircle the ankle region when the foot is placed on the foot sole.

8. The shoe of claim 1, wherein the upper extends to the heel region on the medial and lateral sides of the shoe sole to cup the heel region of the foot.

9. The shoe of claim 1, wherein a plurality of straps are attached to the lateral and medial sides of the shoe sole to removably encircle the ankle region when the foot is placed on the insole and the upper extends to the heel region on the medial and lateral sides of the shoe sole to cup the heel region.

10. The sandal of claim 1, wherein a plurality of sandal straps are attached to the lateral and medial sides of the shoe sole to removably encircle the ankle region when the foot is placed on the insole and the upper extends to the heel region on the medial and lateral sides of the shoe sole to cup the heel region.

11. A shoe for placement of a foot therein, the foot having a foot sole, an ankle region, a heel region, an arch region and toes, each toe including a front region, the shoe comprising:

a shoe sole having a medial side and a lateral side, a top insole surface for placement of the foot sole and toes thereon and a bottom outsole surface, the shoe sole having a plurality of toe extensions projecting below each toe, each toe extension configured to support and retain the toe; and a shoe upper overlaying the arch region, attached to the lateral side and the medial side of the shoe sole and extending toward the toes, wherein the upper is joined to the insole of each toe extension to partially encircle the toe resting on such toe extension and leaving at least the front region of all the toes exposed, wherein at least one toe extension has a plurality of grooves therein to form an accordion-like end to enable the extension to self-adjust to the toe length and have added flexibility and elasticity.

12. The shoe of claim 11, wherein each toe extension has edges that curve upward around the toe to protect regions of the toe.

13. A sandal for placement of a foot therein, the foot having a foot sole, an ankle region, a heel region, an arch region, and toes, each toe including a front region, the shoe comprising:

a shoe sole having a medial side and a lateral side, a top insole surface for placement of the foot sole and toes thereon and a bottom outsole surface, and an open heel the shoe sole having a plurality of toe extensions projecting below each toe, each toe extension configured to support and retain the toe; and a shoe upper overlaying the arch region, attached to the lateral side and the medial side of the shoe sole and extending toward the toes, wherein the upper is joined to the insole of each toe extension to partially encircle the toe resting on such toe extension and leaving at least the front region of all the toes exposed, wherein at least one toe extension has a means for self-adjusting to the toe length.

14. The sandal of claim 13, wherein the means for self adjusting the toe length of the toe extension includes a plurality of grooves in the toe extension to form an accordion-like end to enable the extension to self-adjust to the toe length and have added flexibility and elasticity.

15. The sandal of claim 13, wherein each toe extension is made of a polymeric material that can be softened by heating and molded to a predetermined shape to accommodate the toe.

16. The sandal of claim 13, wherein each toe extension is connected to an adjacent toe extension by webbing.

17. The sandal of claim 13, wherein a plurality of sandal straps are attached to the lateral and medial sides of the shoe sole to removably encircle the ankle region when the foot is placed on the foot sole.

18. The sandal of claim 13, wherein the upper extends to the heel region on the medial and lateral sides of the shoe sole to cup the heel region of the foot.

19. A shoe for placement of a foot therein, the foot having a foot sole, an ankle region, a heel region, an arch region and toes, each toe including a front region, the shoe comprising:

a shoe sole having a medial side and a lateral side, a top insole surface for placement of the foot sole and toes thereon and a bottom outsole surface, the shoe sole having a plurality of toe extensions projecting below the toes, each toe extension configured to support and retain at least one toe; and a shoe upper overlaying the arch region, attached to the lateral side and the medial side of the shoe sole and extending toward the toes, wherein the upper is joined to the insole of each toe extension to partially encircle the at least one toe supported and retained on such toe extension, and leaving at least the front region of all the toes exposed, wherein at least one toe extension has a means for self-adjusting to the toe length.

20. A shoe for placement of a foot therein, the foot having a foot sole, an ankle region, a heel region, an arch region and toes, each toe including a front region, the shoe comprising:

a shoe sole having a medial side and a lateral side, a top insole surface for placement of the foot sole and toes thereon and a bottom outsole surface, the shoe sole having a plurality of toe extensions projecting below the toes, each toe extension configured to support and retain at least one toe; and a shoe upper overlaying the arch region, attached to the lateral side and the medial side of the shoe sole and extending toward the toes, wherein the upper is joined to the insole of each toe extension to partially encircle the at least one toe supported and retained on such toe extension, and leaving at least the front region of all the toes exposed, wherein at least one toe extension has a plurality of grooves therein to form an accordion-like end to enable the extension to self-adjust to the toe length and have added flexibility and elasticity.

* * * * *